United States Patent [19]

Sugiyama

[11] Patent Number: 5,065,882

[45] Date of Patent: Nov. 19, 1991

[54] BEVERAGE CAN TOP

[76] Inventor: Shigeru Sugiyama, 1-9, Hisagi 7-chome, Zushi-shi, Kanagawa-ken, Japan

[21] Appl. No.: 524,186

[22] Filed: May 16, 1990

[30] Foreign Application Priority Data

May 18, 1989 [JP] Japan ..... 1-56480[U]

[51] Int. Cl.[5] ..... B65D 17/34

[52] U.S. Cl. ..... 220/269; 220/268

[58] Field of Search ..... 220/270, 266, 268, 269, 220/272, 273

[56] References Cited

U.S. PATENT DOCUMENTS

| | | | |
|---|---|---|---|
| 4,084,721 | 4/1978 | Perry | 220/269 |
| 4,247,014 | 1/1981 | Walz | 220/269 |
| 4,286,728 | 9/1981 | Fraze et al. | 220/270 |
| 4,367,996 | 1/1983 | Saunders | 220/270 |
| 4,923,084 | 5/1990 | Forbes | 220/270 |

*Primary Examiner*—Stephen Marcus
*Assistant Examiner*—Paul Schwarz
*Attorney, Agent, or Firm*—Browdy and Neimark

[57] ABSTRACT

A new can top structure is provided in a can containing beverage liquid therewithin. On the can top, a ring serving as a jig for forming an opening therein is attached by way of a rivet at the center thereof. The ring has a pull side free end and a push side free end. There is also formed a tear-out portion defined by a scored line in the can top and the push side free end of the ring overlaps part of the tear-out portion. Since the ring is oriented slantwise with respect to the tear-out portion, the ring stays out of the way at the time of consuming the beverage liquid even though the pull side free end of the ring is erected to cause the push side free end to drive part of the tear-out portion into the can such that an opening is formed.

3 Claims, 3 Drawing Sheets

BEVERAGE CAN TOP

BACKGROUND OF THE INVENTION

The present invention relates to a beverage can top having a tear-out portion formed therein by scored lines and more particularly to such a tear-out portion which is pushed into the beverage can be upwardly pulling a ring attached to said tear-out portion through the leverage action to form an opening in the can top.

A conventional can top structure having an opening of this kind is shown in FIG. 6, wherein a pull side free end 3*a* of a ring 3 is pulled upward to press a push side free end 3*c* formed near an attached portion 4 against tear-out portion 5 with a bend 3*b* serving as a fulcrum to tear out said tear-out portion along a scored line 6 and pressing the same to the inside of the can such that an opening A is formed in the can top.

The conventional beverage can top mentioned in the foregoing has a drawback in that the ring 3, when pressing the tear out portion into the can, has its pull side free end 3*a* extends over the opening A to be in the way of part of the consumer's face such as his or her nose.

To avoid it, the consumer can bend again said ring 3 out of the way to the position shown by the two dot chain line in FIG. 7.

However, bending of such a once bent ring 3 can separate the bend 3*b* thereof away from the can top.

SUMMARY OF THE INVENTION

The present invention is directed to solve the aforementioned problem by providing a new beverage can top which essentially comprises a can top structure of a beverage can comprising a can top and a ring attached to said can top by way of a fulcrum, said can top being formed with a tear-out portion defined by a score line formed therein, said ring having a pull side free end and a push side free end, said push side free end of the ring extending above the tear-out portion and adapted to be leveraged to drive part of said tear-out portion into the beverage can and tear out said tear-out portion from said can top to form an opening when the pull side free end of the ring is pulled upward and rotated about said fulcrum, said ring extending at an angle with respect to said opening.

DESCRIPTION OF THE EMBODIMENTS

Figure 1:
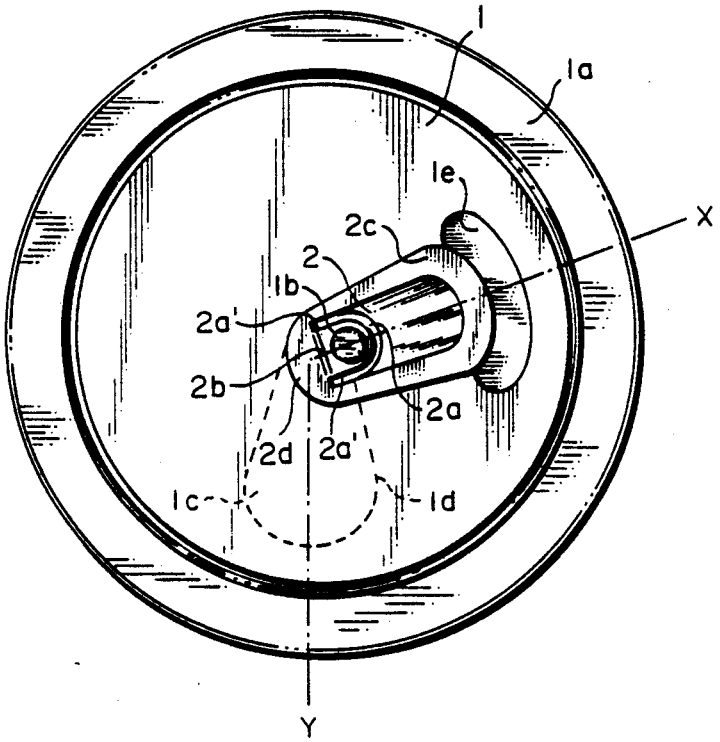
FIG. 1 is a plan view of one embodiment of the present invention.
Figure 2:
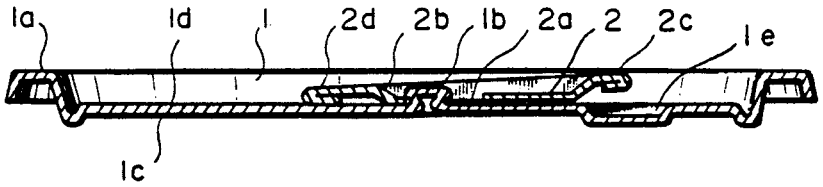
FIG. 2 is a cross section along the line X-Y of FIG. 1.

In FIGS. 1 and 2, a beverage can top 1 of aluminum or other metal has a periphery thereof folded to form a tight bent portion 1*a* to be attached the upper part of the side wall (not shown) of the beverage can. The numeral 2 designates a ring which serves as a jig for forming an opening in the can top 1 and crimp attached to the can top 1 by way of rivet 1*b* formed by embossing part of the can top 1 at the center of the can top 1 such that said rivet 1*b* acts as a fulcrum.

Said ring 2 is formed with a U-shaped slit 2*a* around said rivet 1*b*.

Between opposite two ends 2*a*− of said slit 2*a*, a bend 2*b* is provided. Said ring 2 is further provided with a pull side free end 2*c* extending toward a periphery of the can top and a push side free end 2*d* extending substantially above the center of the can top 1.

The numeral 1*c* designates a tear-out portion defined by a scored line 1*d* which is formed by, for example, making the wall thickness thinner around said tear-out portion. Said push side free end 2*d* of the ring 2 extends above said tear-out portion 1*c* in an overlapping manner.

Figure 3:
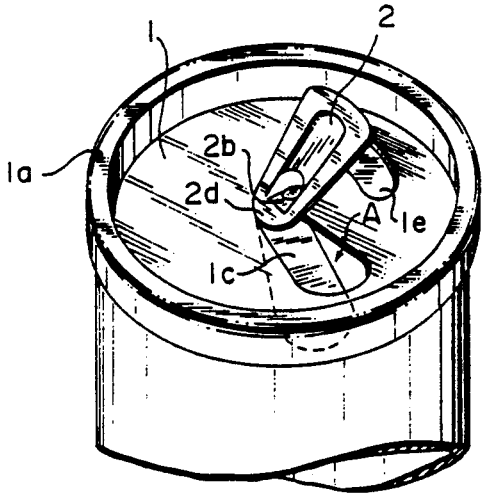
FIG. 3 is a perspective view of said embodiment to show an opening operation of the can top.

By tearing out said tear-out portion along said scored line 1*d* and pressing said tear-out portion 1*c* into the beverage can as shown in FIG. 3, an opening A is formed.

Figure 4:
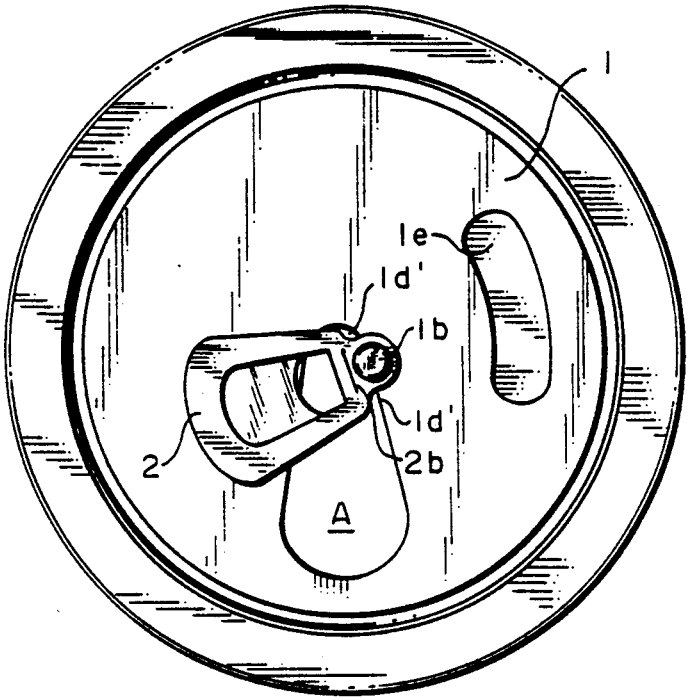
FIG. 4 is a plan view of said embodiment after completion of the opening of the can top.

As shown in FIG. 4, said scored line 1*d* terminates at a transition area 1*d*, by way of which said tear-out portion 1*c* is connected to the can top 1, thus preventing said tear out portion from completely separating therefrom to drop inside the can.

As seen from FIG. 1, said ring 2 is oriented slantwise or substantially perpendicular with respect to said tear out portion 1*c*. In other words, the bend 2*b* of the ring 2 extends substantially parallel or slantwise with respect to a center line Y of the tear-out portion 1*c*. As a result, it is possible to erect said ring 2 while being kept out of the way from the opening A.

Moreover, there is provided a recess 1*e* in the can top 1 under the pull side free end 2*c* of the ring 2 to facilitate an entry of a finger tip.

Hereinafter, an operation of opening the can top in the above embodiment will be explained. First, a finger tip is pushed under the pull side free end 2*c* to pull it upward to bend said bend 2*b* of the ring 2. Said ring is rotated about said bend 2*b* such that the push side free end 2*d* of the ring 2 is leveraged to push and drive part of said tear-out portion 1*c* in a concentrated manner. As a result, the can top near the pressed portion is torn out along the scored line 1*d*.

Further rotation of the ring 2 caused the push side free end 2*d* to turn downward such that the can top is further torn along the scored line 1*d* with the result that the tear out portion 1*c* is pressed into the can in its entirety to form an opening A in the can top 1.

When the opening is fully formed with the tear-out portion 1*c* pressed into the can, the ring 2 is rotated about the bend 2*b* to be erected at an opposite end of the opening A kept out of the way from the periphery of the can top such that the ring provides no obstruction when the liquid beverage is to be consumed.

Figure 5:
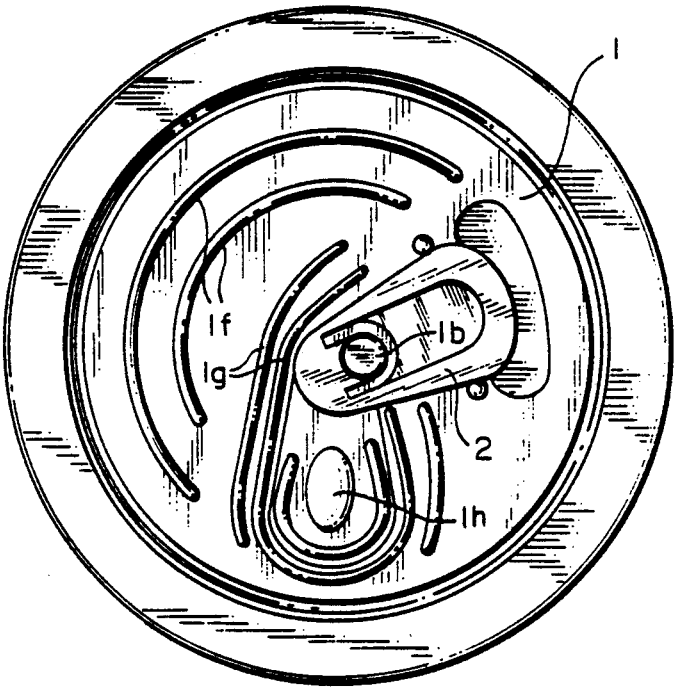
FIG. 5 is a plan view of another embodiment of the present invention.
Figure 7:
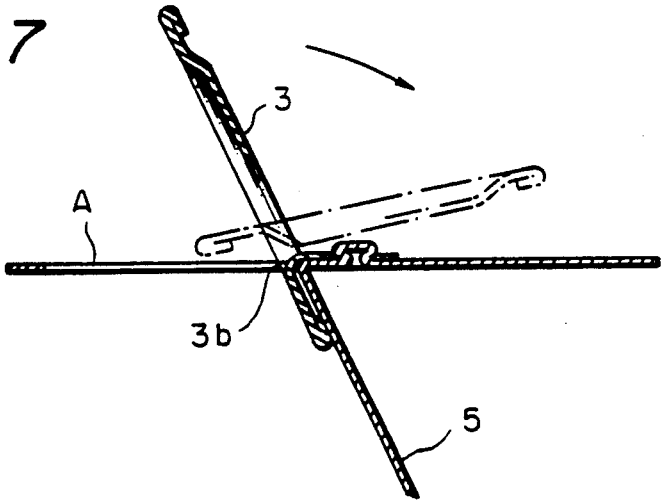
PRIOR ART FIG. 7
FIGS. 6 and 7 are a plan view and a cross section of a prior art beverage can top, respectively.
Figure 6:
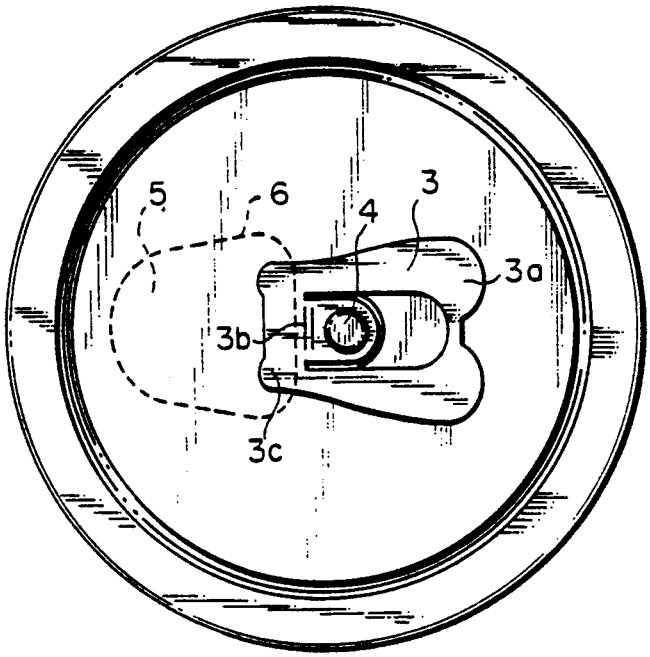
FIG. 6 PRIOR ART

As shown in FIG. 5, reinforcement ribs 1*f*, 1*g* and 1*h* may be formed in the can top at appropriate spacings therebetween.

It may be also advisable to form a reinforcement boss in the tear-out portion 1*c* at an area beneath the push side free end 2*d* of the ring 2.

The present invention is characterized in that the ring is provided to extend slantwise or perpendicular with respect to the tear-out portion of the can top such that the ring erected to press the push side free end into the can is kept out of the way when the liquid beverage is consumed. Further, the need for bending again the ring to the original position is eliminated with the result that the separation of the ring is avoided.

The invention also advantageous in that force is imparted at a localized portion in a concentrated manner to cut out the tear-out portion along the scored line. Thus, the tearing out action requires less force while a need for reinforcing the ring itself is eliminated.

What is claimed is:

1. A can top structure of a beverage can comprising a can top and a ring attached to said can top by way of fulcrum, said can top being formed with a tear-out portion defined by a score line formed therein, a transition area between ends of said score line connecting said tear out portion to said can top, said ring having a pull side free end and a push side free end of the ring extending above the tear-out portion and adapted to be leveraged to drive part of said tear-out portion into the beverage can and tear-out said tear-out portion from said can top to form an opening when the pull side free end of the ring is pulled upward and rotated about said fulcrum, said ring extending at an angle with respect to said opening, wherein said fulcrum is located substantially at the center of the can top on a line drawn between said ends of said score line in said transition area.

2. A can top structure according to claim 1, wherein said can top is formed with a recess beneath said pull side free end of the ring.

3. A can top structure according to claim 1, wherein said can top is formed with reinforcement ribs therein.

* * * * *